United States Patent [19]

Baran

[11] Patent Number: 4,682,373

[45] Date of Patent: Jul. 28, 1987

[54] COLLAPSIBLE HAT CONSTRUCTION

[76] Inventor: Abram Baran, 568 Broadway, New York, N.Y. 10013

[21] Appl. No.: 410,606

[22] Filed: Aug. 23, 1982

[51] Int. Cl.[4] ..... A42B 1/20

[52] U.S. Cl. ..... 2/175; 2/195

[58] Field of Search ..... 2/196, 209.1, 175, 195, 2/171, 200

[56] References Cited

U.S. PATENT DOCUMENTS

| | | | |
|---|---|---|---|
| 478,952 | 7/1892 | Cohen | 2/175 |
| 480,041 | 8/1892 | Schlesinger | 2/175 X |
| 1,213,571 | 1/1917 | Zuckerman | 2/196 |
| 1,697,892 | 1/1929 | Weil | 2/196 |
| 2,701,367 | 2/1955 | Berg | 2/200 |
| 3,739,401 | 6/1973 | Fekete | 2/175 |
| 4,214,318 | 7/1980 | Gomez | 2/209.1 |

*Primary Examiner*—Harvey C. Hornsby
*Assistant Examiner*—Mary A. Ellis
*Attorney, Agent, or Firm*—Charles E. Temko

[57] ABSTRACT

A collapsible hat construction wherein the body and brim of the hat are capable of being folded to generally curved planar condition, and subsequently rolled to furled condition. The outer peripheral band of the hat is provided with an auxiliary strap selectively engaged with plural snap fastener components. In one condition of engagement, the strap lies upon the band to conform to the outer surface thereof. In a second condition it engages another snap fastener component to maintain the hat in furled condition.

2 Claims, 4 Drawing Figures

COLLAPSIBLE HAT CONSTRUCTION

BACKGROUND OF THE INVENTION

This invention relates generally to the field of hats, and more particularly to an improved sport type hat, which, when not in use, may be conveniently collapsed for storage within an overcoat pocket or the like.

In recent years, there has been a significant trend away from the traditional felt hat, partially because of considerations of cost, but also because of the substantial shortcomings of felted material, including fading, the necessity for frequent cleaning and blocking, and the like.

The now quite popular, less formal, type of hat is made from synthetic resinous materials, typically polyesters stitched over a substantial area to a suitable nonwoven filler. Such construction may be repeatedly crushed without damage, the hat returning to normal shape when subsequently worn. However, in the case of a hat of this type which includes both a crown and a brim, it is not readily folded to planar condition for storage in a pocket or the like. It can be merely crumpled to occupy a substantial volume, and there is no provision for maintaining a collapsed condition.

SUMMARY OF THE INVENTION

Briefly stated, the invention contemplates the provision of an improved brimmed type hat of the class described, in which provision is made for storing the hat in furled condition. The hat includes a crown element with peripheral brim element, which are interconnected by a peripheral band. Overlying the band is an auxiliary strap selectively attached thereto by snap fastener means. When the hat is worn, the strap overlies the band. When the hat is collapsed, it is first folded diagonally to generally curved planar condition, and subsequently rolled to furled configuration where it is maintained by reattaching the auxiliary strap to another snap fastener element on the band.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
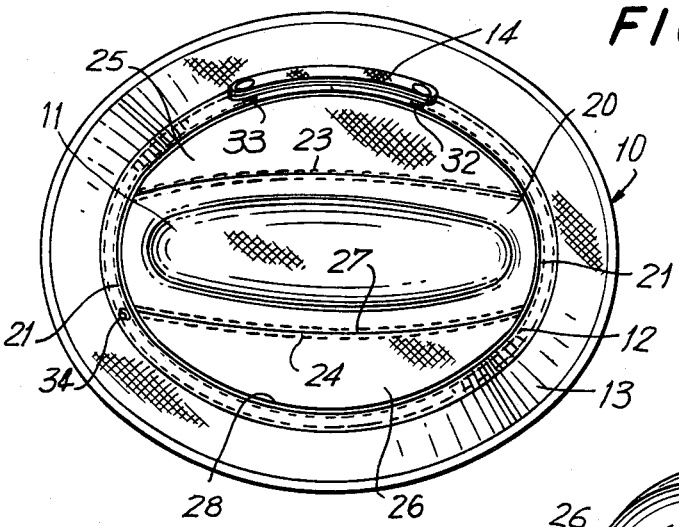
FIG. 1 is a top plan view of an embodiment of the invention in erected condition.

In accordance with the invention, the device, generally indicated by reference character 10, comprises broadly: a crown element 11, a band element 12, a brim element 13, and an auxiliary strap member 14.

The crown element 11 may be constructed in conventional fashion, including a top panel 20 bounded by end edges 21 and side edges 23 and 24. Interconnected with the top panel is a pair of side panels 25 and 26, each being bounded by an upper curvilinear edge 27 and a lower edge 28.

The band element 12 comprises an elongated strip of material bounded by an upper edge 30 and a lower edge 31. Extending outwardly from an outer surface thereof are first, second, and third snap fastener components 32, 33, and 34, respectively.

The brim element 13 is bounded by an inner edge 40 interconnected to the lower edge 31 of the band element 12 and an outer edge 41.

The auxiliary strap element 14 is approximately four inches long, and of a width corresponding to that of the band element 12. Disposed at first and second ends 50 and 51 are corresponding snap fastener components 52 and 53. When the device is in erected condition, the components 52 and 53 are engaged with the components 32 and 33 wherein the strap is maintained in coplanar relation to the outer surface of the band element 12.

Figure 2:
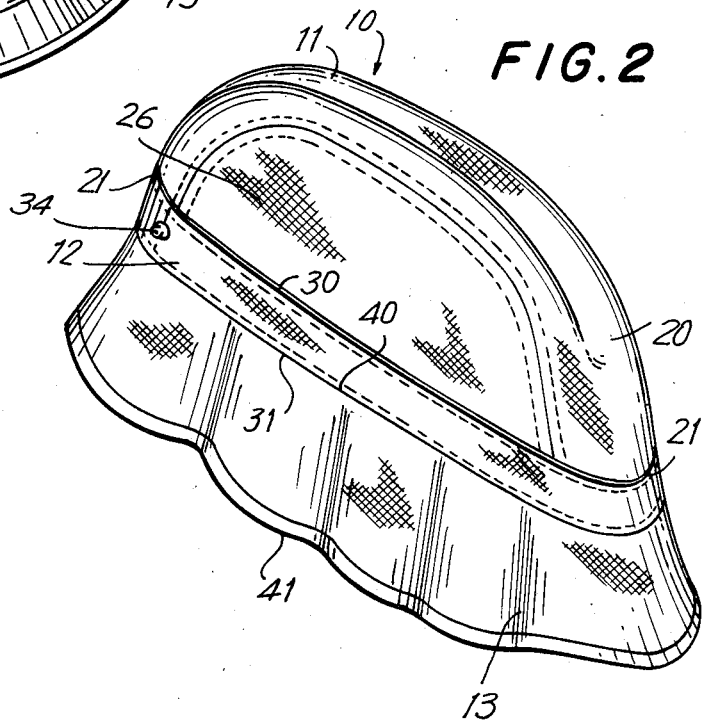
FIG. 2 is a perspective view showing a first step in the collapsing thereof.
Figure 3:
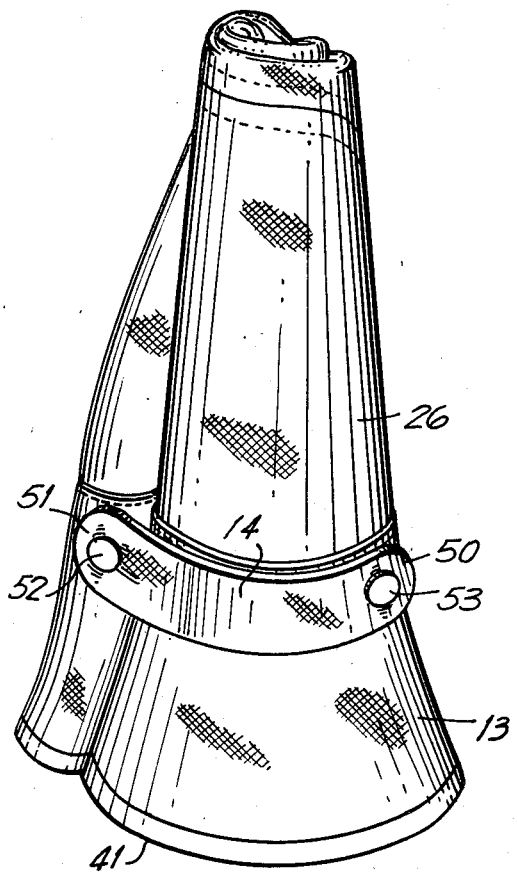
FIG. 3 is a view in perspective showing the embodiment in fully furled condition.
Figure 4:
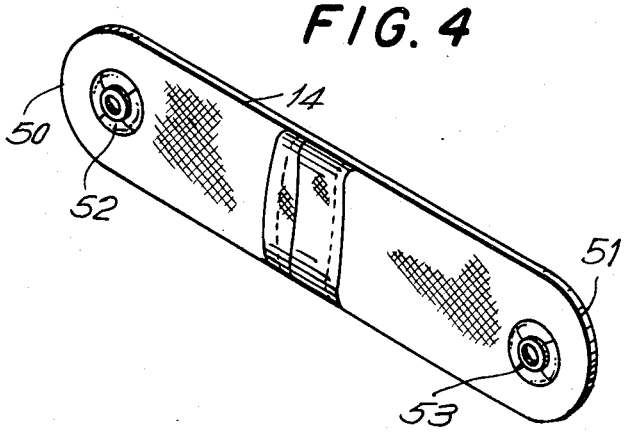
FIG. 4 is a view in elevation of an auxiliary strap member forming part of the embodiment.

FIG. 2 illustrates a first step in the collapsing of the device 10, wherein the hat is folded by moving the front portion of the crown element against the rear portion of the crown element to bring the hat into curvilinear planar condition. Referring to FIG. 3, the hat is next rolled to furled condition wherein it assumes a quasi-conical configuration. In this condition, the strap member 14 has been disconnected at the second end 51 thereof to permit engagement with the third snap fastener component 34 which is spaced from the component 33 a distance of approximately six inches. Following such engagement, the inner convolution of the hat may be twisted slightly to assure maximum furling. In this condition, the hat can be easily stored in an overcoat pocket or the like or placed within a handbag or piece of luggage to occupy minimum volume.

Although in the disclosed embodiment the strap member 14 is completely detachable, it is also possible to form the hat such that one end of the strap member is permanently interconnected to the band element, as by stitch means (not shown). While presenting a somewhat less attractive appearance, this alternate form prevents loss of the strap member.

I wish it to be understood that I do not consider the invention limited to the precise details of structure shown and set forth in this specification, for obvious modifications will occur to those skilled in the art to which the invention pertains.

I claim:

1. In a collapsible hat including a crown element, a brim element, and a band element interconnecting said crown and brim elements, the improvement comprising: said band element having at least two snap fastener components mounted on an outer surface thereof in spaced relation, an auxiliary strap member having first and second ends, said first end having means for attachment to said outer surface of said band element, said second end having a corresponding snap fastener component selectively engageable with each of said above mentioned snap fastener components, whereby: said hat in erected condition may support said strap in overlying relation relative to the said outer surface of said band element by engagement with one of said snap fastener components on said band element; said hat being collapsed by first folding said crown, band and brim elements to curvilinear planar condition, and subsequently winding the same to furled condition, in which condition said strap element is engaged with the other of said snap fastener components to maintain said furled condition.

2. The improvements set forth in claim 1, further characterized in said first end having a snap fastener component for engagement with a corresponding snap fastener component on said band element.

* * * * *